US006082438A

United States Patent [19]

Zielinski et al.

[11] Patent Number: 6,082,438

[45] Date of Patent: Jul. 4, 2000

[54] METHOD AND SYSTEM FOR THE CONTROL OF A VACUUM VALVE OF A VACUUM DIE CASTING MACHINE

[75] Inventors: Michael D. Zielinski, Pewaukee; Edward M. Nelson, Franklin, both of Wis.

[73] Assignee: Outboard Marine Corporation, Waukegan, Ill.

[21] Appl. No.: 08/946,803

[22] Filed: Oct. 8, 1997

[51] Int. Cl.[7] ..... B22D 17/32

[52] U.S. Cl. ..... 164/457; 164/113; 164/155.5; 164/312

[58] Field of Search ..... 164/457, 155.5, 164/155.4, 113, 312, 305

[56] References Cited

U.S. PATENT DOCUMENTS

| | | |
|---|---|---|
| 3,729,047 | 4/1973 | Bohnlein et al. . |
| 4,335,778 | 6/1982 | Motomura et al. . |
| 4,463,793 | 8/1984 | Thurner . |
| 4,488,589 | 12/1984 | Moore et al. . |
| 4,493,362 | 1/1985 | Moore et al. . |
| 4,559,991 | 12/1985 | Motomura et al. . |
| 4,881,186 | 11/1989 | Tsuboi et al. . |
| 4,986,338 | 1/1991 | Yamaychi et al. . |
| 5,022,457 | 6/1991 | Iwamoto et al. . |
| 5,086,824 | 2/1992 | Tsuda et al. . |
| 5,365,999 | 11/1994 | Stummer et al. . |
| 5,511,605 | 4/1996 | Iwamoto . |

FOREIGN PATENT DOCUMENTS 3-608853 3/1991 Japan ..... 164/457

OTHER PUBLICATIONS

*Introduction to Optics*, Pedrotti, et al., "Two–Layer Antireflecting Films", Sec. 22–3, Prentice–Hall, Inc. 1987.

*Primary Examiner*—Kuang Y. Lin
*Attorney, Agent, or Firm*—Armstrong Teasdale LLP

[57] ABSTRACT

A vacuum valve control system for a vacuum die casting machine that controls the opening and closing of a vacuum valve. The system comprises an input device for entering certain values, a detecting device for determining the position and speed of an injection plunger, a processor to calculate when the injection plunger has reached particular values for position and speed and a control device for opening and closing the vacuum valve when the particular values have been reached. The processor includes two counting devices, one to calculate the position of the injection plunger and one to calculate the speed of the plunger. The control device includes solid state relays which energize a solenoid to open the vacuum valve when the plunger has reached a certain position. The solid state relays also deenergize the solenoid to close the vacuum valve when either another particular position of the plunger has been reached or when the plunger is approaching a certain speed. By monitoring the speed and position of the injection plunger to control the vacuum valve, the chance that molten metal will be suctioned into the vacuum system of the vacuum die casting machine is greatly reduced.

15 Claims, 4 Drawing Sheets

METHOD AND SYSTEM FOR THE CONTROL OF A VACUUM VALVE OF A VACUUM DIE CASTING MACHINE

BACKGROUND OF THE INVENTION

1. Field of the Invention

The present invention relates to a vacuum die casting machine and to a method of operating such machine. More particularly, the invention relates to a control system which closes the vacuum valve of a vacuum die casting machine prior to the suction of molten metal into the vacuum system.

2. Description of the Related Art

Vacuum die casting machines are used to produce metal products. Generally, the machines consist of a cavity in a metal die mold which forms the product to be cast. One end of the cavity connects to an injection sleeve. Molten metal is poured into the sleeve and is injected into the cavity by an injection plunger, which is fitted in the sleeve. The plunger initially moves at a "slow-shot" speed, which is dictated by a controller of the die casting machine. Just prior to the molten metal's injection into the cavity, the plunger moves at a "fast-shot" speed. To create quality parts with low porosity, it is essential that the gas in the cavity and the injection sleeve is evacuated prior to the molten metal's injection into the cavity. Accordingly, a vacuum system is connected to a second end of the cavity of the die casting machine. Prior to the injection of the molten metal into the cavity, a vacuum valve opens to allow the vacuum system to evacuate the gas in the cavity and the injection sleeve. This vacuum valve, however, must be closed before any molten metal is suctioned into the vacuum system. If the valve is open when the plunger reaches fast-shot speed, it is likely that the molten metal will enter the vacuum system due to the speed at which the molten metal is traveling coupled with the suction produced by the vacuum system. If molten metal were to be suctioned into the vacuum system, the vacuum die-casting machine would have to be shut down. Maintenance would be required prior to the production of any more quality parts. To ensure a high level of productivity, it is therefore essential that the vacuum valve is closed prior to the suction of molten metal into the vacuum system and by the time fast-shot speed is reached.

In known embodiments of vacuum die casting machines, the closing of the vacuum valve is controlled by the position of the injection plunger. When the plunger reaches a set position, a signal is sent to close the valve. These embodiments, however, do not account for variations that may occur in the injection process, causing fast-shot speed to start prior to the closing of the valve. Since numerous factors may vary, such as, the lubrication in the injection plunger, the pressure of the hydraulic cylinder and the parameters entered by the controller, it is undesirable to have the closing of the valve dictated solely by a set position of the plunger.

In another embodiment, when the plunger reaches a pre-selected position, a signal is sent to close the valve and for the plunger to enter fast-shot mode. If the vacuum valve is not fully closed by the time the plunger is about to enter fast-shot mode, the plunger will retract until the valve has properly closed. This embodiment is inefficient, however, since the retraction of the plunger slows down the production process.

In yet another embodiment, the closing of the vacuum valve is controlled by an apparatus that detects the presence of molten metal. Upon detecting molten metal, the device sends a signal to the vacuum valve to close. This system is inadequate since if the valve is still open when the injection plunger reaches fast-shot speed, the molten metal will become atomized into a spray. The detection member may not adequately detect the atomized spray, therefore allowing it to enter the vacuum system.

Other known embodiments detect conditions in which it is likely that the vacuum system has become clogged. These systems measure the air speed in the vacuum piping and the degree of vacuum. Comparing these values to certain pre-set values, the systems determine whether clogging is likely to have occurred. If clogging is likely an alarm sounds. These systems are inadequate since they merely inform the controller that clogging is likely to have occurred and that the machine may need maintenance. They do not prevent the clogging of the vacuum system.

The numerous prior attempts to provide a control system for a vacuum die casting machine to close the vacuum valve prior to the suction of molten metal into the valve system have yet to produce an optimal system.

SUMMARY OF THE INVENTION

The difficulties encountered by previous systems have been overcome by the present invention. What is described is a vacuum die casting apparatus comprising in combination a mold having a cavity, vacuum means connected to said mold for evacuating said cavity, a vacuum valve between said cavity and said vacuum means, an injection plunger for filling said cavity with material and a control system comprising speed input means for entering a first speed of said injection plunger, speed processing means for calculating a second speed based on said first speed and for determining when said injection plunger has reached said second speed and means for closing said vacuum valve when said injection plunger has reached said second speed. The invention also includes a method for controlling a vacuum die casting system which includes a mold having a cavity, vacuum means connected to said mold for evacuating said cavity, a vacuum valve between said cavity and said vacuum means, and an injection plunger for filling said cavity with material, said method comprising the steps of determining a first speed of said injection plunger, calculating a second speed based on said first speed, measuring the speed of said injection plunger, comparing said measured speed with said second speed and closing said vacuum valve if said measured speed is greater than or equal to said second speed.

An object of the present invention is to provide an apparatus and method for a vacuum die casting machine whose vacuum valve will be closed at the time the injection plunger reaches fast-shot speed so that molten metal will not enter and clog the vacuum system. Another object of the present invention is to provide an apparatus and method for a vacuum die casting machine whose vacuum valve will be closed at a predetermined position of the injection plunger if the plunger has yet to attain fast-shot speed. The vacuum valve is controlled by high-speed counting devices that calculate the position and speed of the injection plunger. One high-speed counting device calculates the speed of the plunger, while another calculates the position of the plunger. When either device has reached a maximum allowable value, the vacuum valve will be closed. Therefore, the likelihood that molten metal will clog the vacuum system is minimal.

A further aspect of the present invention is to provide an apparatus and method for a vacuum valve control system that can be utilized by different die casting machines.

Regardless of how the die-casting machine is set-up, the vacuum valve control system should be able to close the vacuum valve prior to the plunger reaching fast-shot speed. Accordingly, there will be less clogging of the vacuum valve, allowing the different die casting machines to be operating instead of being shut down.

A more complete understanding of the present invention and other objects, aspects, aims and advantages thereof will be gained from a consideration of the following description of the preferred embodiment read in conjunction with the accompanying drawings provided herein.

DETAILED DESCRIPTION OF THE INVENTION

Figure 1:
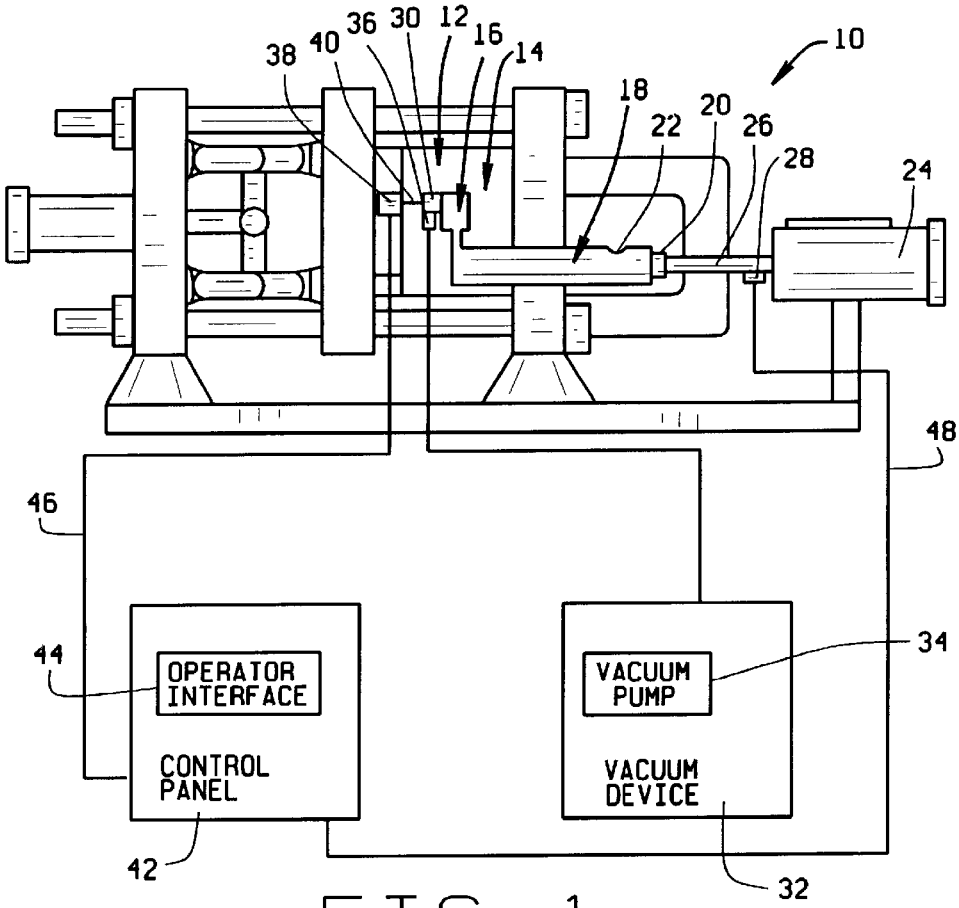
FIG. 1 is a diagrammatic view showing one embodiment of the vacuum die casting system according to this invention.

While the present invention is open to various modifications and alternative constructions, the preferred embodiments shown in the drawings will be described herein in detail. It is understood, however, that there is no intention to limit the invention to the particular forms disclosed. On the contrary, the intention is to cover all modifications, equivalents and alternatives falling within the spirit and scope of the invention as expressed in the appended claims.

Referring to FIG. 1, there is illustrated a vacuum die casting machine 10. The machine consists of a moving die 12 and a stationary die 14, which when brought together form a cavity 16. Through the stationary die 14, one end of the cavity 16 comes into contact with an injection sleeve 18. A plunger 20 is slidably fit in the injection sleeve 18. The injection sleeve 18 contains an inlet 22 into which molten metal (not shown) is poured. A hydraulic cylinder 24 controls the movement of the plunger 20 by way of a rod 26 connecting the hydraulic cylinder 24 and plunger 20. The movement of the plunger 20 causes the molten metal to fill the cavity 16. A position encoder 28 is attached to the rod 26 to help determine the position and speed of the plunger 20.

A second end of the cavity 16 is connected to a vacuum valve 30. The vacuum valve 30 is further connected to a vacuum device 32, which is known to those of ordinary skill in the art. The vacuum device 32 consists in part of a vacuum pump 34. When the vacuum valve 30 is open, the vacuum device 32 discharges the gas from the cavity 16 and injection sleeve 18. While a pressure of thirty (30) inches of mercury is ideal to evacuate all gas in the cavity 16, the vacuum device 32 of the preferred embodiment creates a pressure of twenty six (26) to twenty seven (27) inches of mercury inside the cavity 16. A filter canister 36 may also be connected to the vacuum valve 30 to help prevent metal from entering the vacuum device 32.

The vacuum valve 30 is opened and closed by way of a vacuum valve actuator 38. The vacuum valve actuator 38 contains a solenoid which controls a pin 40 that is connected to the vacuum valve 30. In the preferred embodiment, the solenoid is a slightly modified Trombetta Q515-A17. The core of the preferred solenoid is shaven to reduce the mass of the solenoid, allowing the vacuum valve 30 to close faster.

Figure 2:
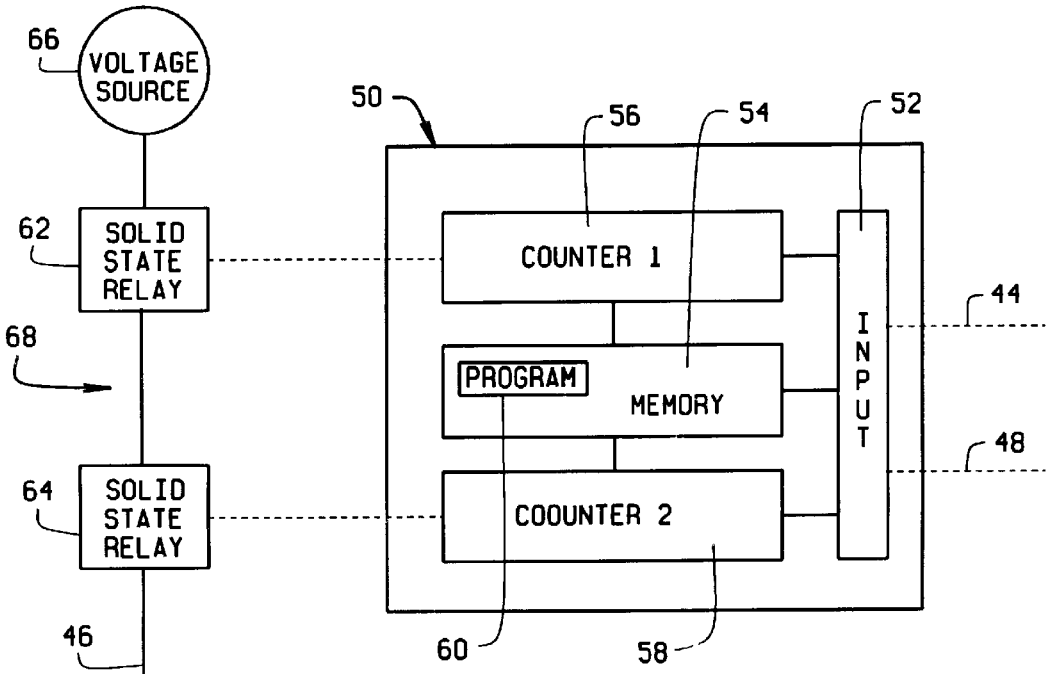
FIG. 2 is a diagrammatic view of the processor contained within the control panel shown in FIG. 1.

The principal purpose of this invention is to close the vacuum valve 30 prior to the plunger 20 reaching fast-shot speed, to prevent molten metal from being suctioned into the vacuum device 32. The vacuum valve 30 is controlled primarily by a control panel 42 and its constituent parts. The control panel 42 includes an operator interface 44 by which a user enters information. The preferred embodiment utilizes the Allen-Bradley DTAM Plus as the operator interface 44. The control panel 42 is connected to the vacuum valve actuator 38 by a cable 46. The control panel 42 also is connected to the position encoder 28 by a cable 48. The control panel 42 contains a processor 50 which will now be discussed with reference to FIG. 2.

The processor 50 contained within the control panel 42 contains an input port 52, a memory device 54 and two high-speed counting devices 56 and 58. In the preferred embodiment, the processor 50 is an Allen-Bradley SLC500 Programmable Logic Controller. One of the high-speed counting devices 56 determines the position of the plunger 20, while the other high-speed counting device 58 determines the plunger's speed. By monitoring the plunger's speed, the objective of closing the vacuum valve 30 prior to the plunger 20 reaching fast-shot speed can be achieved. The operator interface 44 and the position encoder cable 48 are connected as input to the input port 52. The input port 52 is further connected to the memory device 54 and to the two high-speed counting devices 56 and 58. The memory device 54, which stores a program 60, is connected to the two high-speed counting devices 56 and 58. Each high-speed counting device 56 and 58 is connected to a corresponding solid state relay 62 and 64 housed outside of the processor 50. In the preferred embodiment, Crydom D2D12s are used as the solid state relays 62 and 64. A voltage source 66 is connected to the first solid state relay 62, which in turn is connected to the second solid state relay 64. This connection comprises the solid state relay circuit 68. In the preferred embodiment, the voltage source 66 is a 108 volt direct current. The cable 46 that connects the control panel 42 to the vacuum valve actuator 38 originates from the second solid state relay 64.

Figure 3:
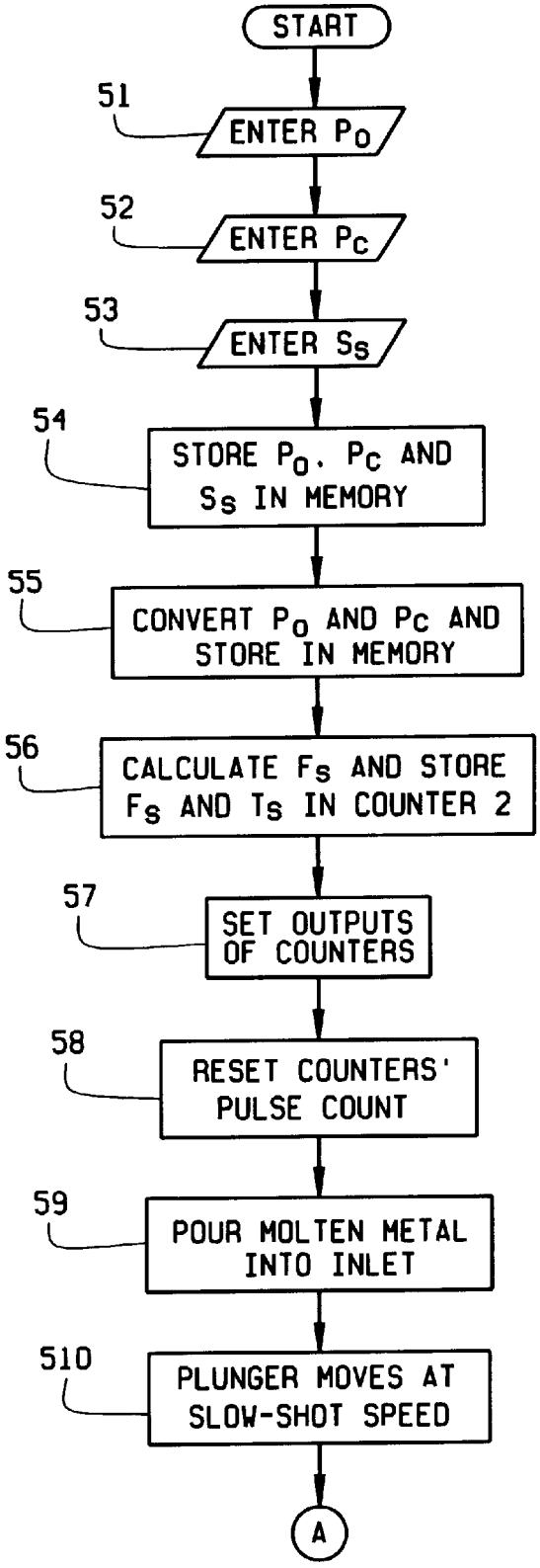
FIGS. 3 and 4 are a flow diagram of the operation of the vacuum die casting system according to this invention.
Figure 4:
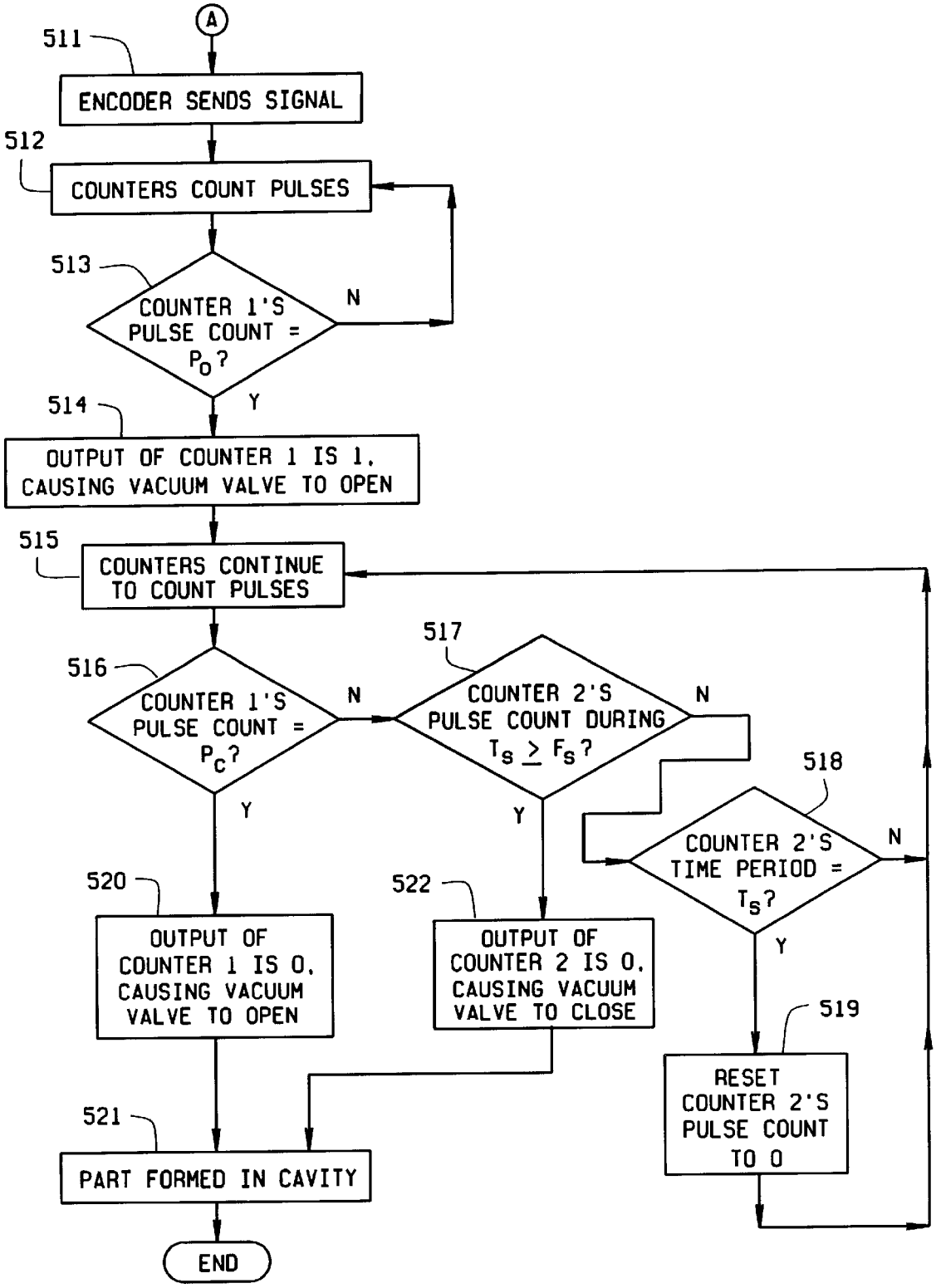

The operation of the vacuum die casting machine 10 of this invention will now be explained by reference to the flow chart of FIGS. 3 and 4. When the production of parts is to begin, the user enters various parameters via the operator interface 44 on the control panel 42. The user enters a position $P_O$ of the plunger 20 at which the vacuum valve 30 should open (step S1) and a position $P_C$ of the plunger 20 at which the vacuum valve 30 should close (step S2). Both $P_O$ and $P_C$ are entered in inches or some other suitable unit of measure. In the preferred embodiment, $P_O$ is the position of the plunger 20 immediately after it has covered the inlet 22 of the injection sleeve 18. The user also enters a slow-shot speed $S_S$ at which the plunger 20 will initially move (step S3). $S_S$ is entered in inches per second. These values are transmitted from the operator interface 44 to the processor 50. More specifically, these values are stored in the memory device 54 of the processor 50 (step S4). The memory device 54, in conjunction with the program 60, convert $P_O$ and $P_C$ from inches to pulses based on the number of pulses the high-speed counting devices 56 and 58 would count per inch. The processor 50 stores the converted values of $P_O$ and $P_C$ into the first high-speed counting device 56 (step S5). The program 60 contains a value for a time period $T_S$ during which the second high-speed counting device 58 will count pulses. The program also contains a safety factor $S_F$ which helps to determine when fast-shot speed is being reached. $S_F$ is a percentile which is entered by a programmer. In the preferred embodiment, $S_F$ is equal to ten percent. When the speed of the plunger 20 has exceeded $S_S+(S_F \times S_S)$, it is likely that the plunger 20 is reaching fast-shot speed. The utilization of $S_F$ allows for slight variations in the speed of the plunger 20 without assuming that fast-shot speed is approaching. The memory device 54 and program 60 thus calculate a fast-shot approach speed $F_S$ at which it appears that the plunger 20 is reaching fast-shot speed. $F_S$ is equal to $S_S+(S_F$ of $S_S)$. The program 60 converts $F_S$ from inches per second to a number of pulses per the time period $T_s$. The processor 50 stores the converted value of $F_S$, along with $T_S$, into the second high-speed counting device 58 (step S6). The program 60 initially sets the output of the first high-speed counting device 56 to 0 (zero) and the output of the second high-speed counting device 58 to 1 (one) (step S7). Accordingly, the solid state relay circuit 68 is broken, causing the vacuum valve 30 to remain closed. The program 60 also initially sets the pulse count of the high-speed counting devices 56 and 58 to 0 (zero) (step S8). The remaining operation of the vacuum valve control system, while utilizing the high-speed counting devices 56 and 58, does not use the other components of the processor 50. By allowing the high-speed counting devices 56 and 58 to control the valve 30 without the use of the other components of the processor 50, the valve 30 can close more rapidly.

The production of a part starts with the plunger 20 in an unadvanced position. Molten metal is poured into the inlet 22 in the injection sleeve 18 (step S9). The hydraulic cylinder 24 then causes the plunger 20 to advance at slow-shot speed (step S10). The position encoder 28 on the rod 26 of the plunger 20 continuously sends pulses to the high-speed counting devices 56 and 58 in the processor 50 indicating the position of the plunger 20 (step S11). In the preferred embodiment, the position encoder 28 sends a five volt quadrature signal. The high-speed counting devices 56 and 58 count the pulses sent by the position encoder 28 (step S12). The first high-speed counting device 56 continuously determines whether the pulse count equals $P_O$ (step S13). The high-speed counting devices 56 and 58 continue to count pulses if the pulse count does not yet equal $P_O$ (step S12). When the first high-speed counting device 56 has counted a number of pulses equal to $P_O$, this high-speed counting device 56 changes its output to 1 (one). Since the outputs from both high-speed counting devices 56 and 58 are 1 at this time, the inputs to the two solid state relays 62 and 64 are similarly 1. Therefore, the solid state relay circuit 68 has been completed allowing for the voltage signal to be sent from the solid state relay circuit 68 to the vacuum valve actuator 38. The solenoid within the vacuum valve actuator 38 is energized, causing the vacuum valve 30 to open. With the vacuum valve 30 open, the vacuum device 32 evacuates the water vapor and other gases in the cavity 16 and injection sleeve 18 (step S14).

The plunger 20 in the injection sleeve 18 continues to advance and push the molten metal towards the cavity 16. Simultaneously, the position encoder 28 continues to send pulses to the processor 50, in which the high-speed counting devices 56 and 58 count the pulses (step S15). The first high-speed counting device 56 determines whether the pulse count equals $P_C$ (step S16). If the pulse count does not yet equal $P_C$, the second high-speed counting device 58 determines whether the pulse count during the time period $T_S$ is greater than or equal to $F_S$ (step S17). If the pulse count during the time period $T_S$ is greater than or equal to $F_S$, it is highly likely that the plunger 20 is increasing its speed towards fast-shot speed. If the second high-speed counting device's 58 pulse count is less than $F_S$, the plunger 20 is still moving at slow-shot speed. In this circumstance, the second high-speed counting device's 58 count number needs to be reset to zero each time the time period $T_S$ has been reached. Accordingly, if the second high-speed counting device 58 has been counting pulses for a time period of $T_S$ (step S18), the pulse count of this counting device 58 will be reset to zero (step S19). In either case, both high-speed counting devices 56 and 58 will continue to count the pulses from the position encoder 28 (step S15). When the pulse count from the first high-speed counting device 56 equals $P_C$ (step S16), the output of this high-speed counting device 56 will change to 0 (zero). Since the outputs of the high-speed counting devices 56 and 58 at this time would be a zero and a one, the inputs of the solid state relays 62 and 64 would be a zero and a one. This breaks the solid state relay circuit 68, causing the solenoid in the vacuum valve actuator 38 to deenergize. Accordingly, the vacuum valve 30 will close (step S20). Since fast-shot speed would not yet have been reached and because the vacuum valve 30 closed at a predetermined position, it is highly unlikely that any molten metal will have advanced past the cavity 16. A quality part should have now formed within the cavity 16 (step S21), while the vacuum device 32 is not clogged by molten metal.

One of the major advantages of this invention is the ability to close the vacuum valve 30 when fast-shot speed is approaching, even when the plunger 20 has not yet reached $P_C$. In the circumstance when fast-shot speed is approaching prior to the plunger 20 reaching $P_C$, the second high-speed counting device 58 would have a pulse count greater than or equal to $F_S$ (step S17). When this occurs, the output of the second high-speed counting device 58 is changed to 0 (zero). At this time, the outputs from the high-speed counting devices 56 and 58 are a zero and a one. Therefore, the inputs of the solid state relays 62 and 64 are a zero and one. This breaks the solid state relay circuit 68, causing the solenoid in the vacuum valve actuator 38 to deenergize. Accordingly, the vacuum valve 30 will close (step S22). Even though the plunger 20 has not yet reached $P_C$, the vacuum valve 30 will be closed due to the plunger's 20 high speed. Closing the vacuum valve 30 when fast-shot speed is imminent helps to prevent molten metal from being suctioned into the vacuum device 32 and clogging it. Furthermore, a quality part should now have formed within the cavity 16 (step S21).

Figure 5:
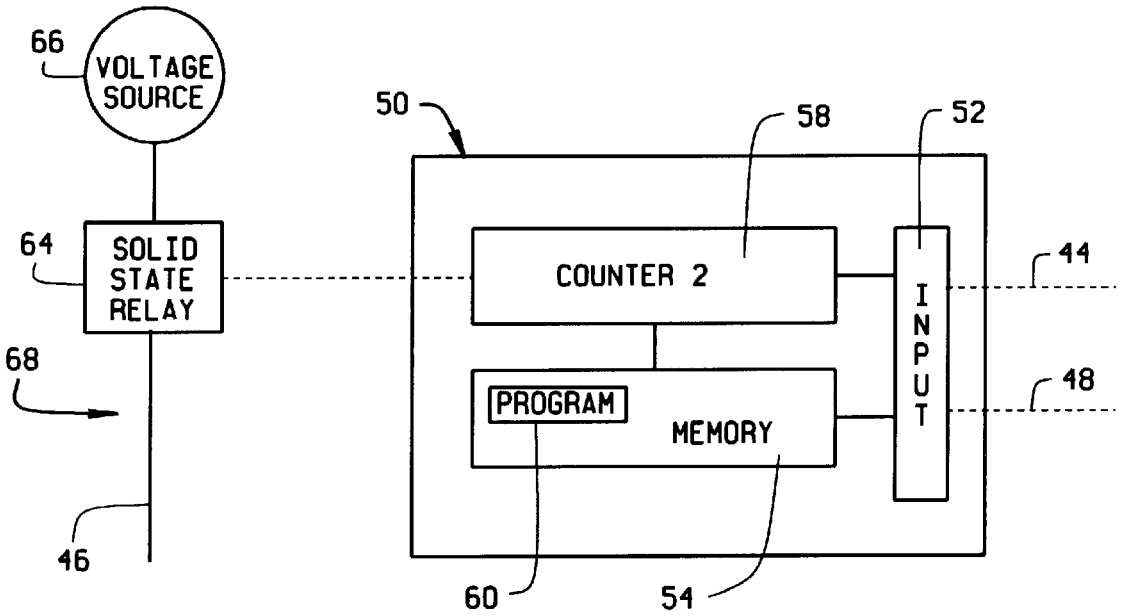
FIG. 5 is a diagrammatic view of a second embodiment of the processor within the control panel shown in FIG. 1.

Another embodiment of the present invention will now be described with reference to FIG. 5. This embodiment of the present invention contains only one high-speed counting device 58. This high-speed counting device 58 operates in a manner similar to the second high-speed counting device 58 of the first embodiment. The counting device 58 monitors the speed of the plunger 20 by counting the pulses from the position encoder 28 over a time period $T_S$. When the plunger's speed is equal to or greater than $F_S$, the output of the counting device 58 changes to 0 (zero). This breaks the solid state relay circuit 68, which in this embodiment would consist of only one solid state relay 64. The solenoid in the vacuum valve actuator 38 would be deenergized, causing the vacuum valve 30 to close. In this manner, the vacuum valve 30 would be closed when fast-shot speed is imminent. Therefore, there is little chance of molten metal being suctioned into the vacuum device 32. In this embodiment, the opening of the vacuum valve 30 can be controlled by various means known to those skilled in the art.

An advantage of the present invention is that the vacuum valve control system can effectively control the vacuum valve 30 in conjunction with almost any die casting machine. Regardless of the die casting machine's method of operation or the manner by which the controller sets up the machine, the vacuum valve control system will be able to close the vacuum valve 30 prior to the plunger 20 reaching fast-shot speed. By constantly monitoring the plunger's speed, the vacuum valve control system helps to prevent clogging of the vacuum device 32.

The present invention is effective regardless of the manner by which the plunger 20 increases speed from slow-shot to fast-shot. Because the processor 50 detects an increase in the speed of the plunger 20, the approach of fast-shot speed will be detected regardless of whether the speed increase profile is stepped, ramped or parabolic. Therefore, the vacuum valve control system of the present invention prevents molten metal from clogging the vacuum device 32 of a vacuum die casting machine 10 regardless of how the speed increases.

The specification describes in detail several embodiments of the present invention. Other modifications and variations will, under the doctrine of equivalents, come within the scope of the appended claims. For example, monitoring the position of the plunger by limit switches while the speed is monitored by a high-speed counting device and a vacuum valve actuator consisting of multiple solenoids are considered equivalent devices Still other alternatives will also be equivalent as will many new technologies. There is no desire or intention here to limit in any way the application of the doctrine of equivalents.

What is claimed is:

1. A vacuum die casting apparatus comprising in combination:

a mold having a cavity;

vacuum means connected to said mold for evacuating said cavity;

a vacuum valve between said cavity and said vacuum means;

an injection plunger for filling said cavity with material; and a control system comprising:

speed input means for entering a first speed of said injection plunger;

speed processing means for calculating a second speed based on said first speed and for determining when said injection plunger has reached said second speed; and means for closing said vacuum valve when said injection plunger has reached said second speed.

2. The vacuum die casting apparatus of claim 1 wherein said speed processing means comprises a position encoder and a high-speed counting device for measuring the speed of said injection plunger and for comparing said measured speed with said second speed.

3. The vacuum die casting apparatus of claim 1 wherein said control system further comprises:

position input means for entering a first position and a second position of said injection plunger at which said vacuum valve should respectively open and close;

position processing means for determining when said injection plunger has reached said first and second positions; and means for opening said vacuum valve when said injection plunger has reached said first position and for closing said vacuum valve when said injection plunger has reached said second position.

4. The vacuum die casting apparatus of claim 3 wherein said position processing means comprises a position encoder and a high-speed counting device for measuring the position of said injection plunger and for comparing said measured position with said first and second positions.

5. The vacuum die casting apparatus of claim 1 wherein said speed processing means for calculating said second speed adds a percentage value to said first speed.

6. A method for controlling a vacuum die casting system which includes a mold having a cavity, vacuum means connected to said mold for evacuating said cavity, a vacuum valve between said cavity and said vacuum means, and an injection plunger for filling said cavity with material, said method comprising the steps of:

determining a first speed of said injection plunger;

calculating a second speed based on said first speed;

measuring the speed of said injection plunger;

comparing said measured speed with said second speed; and closing said vacuum valve if said measured speed is greater than or equal to said second speed.

7. The method for controlling a vacuum die casting system of claim 6 wherein the step of measuring the speed of said injection plunger comprises counting the number of pulses generated by a position encoder on said injection plunger in a time period.

8. The method for controlling a vacuum die casting system of claim 6 further comprising the steps of:

determining a first position and a second position of said injection plunger at which said vacuum valve should respectively open and close;

measuring the position of said injection plunger;

comparing said measured position with said first and second positions; and opening said vacuum valve if said measured position equals said first position and closing said vacuum valve if said measured position equals said second position.

9. The method for controlling a vacuum die casting system of claim 8 wherein the step of measuring the position of said injection plunger comprises counting the number of pulses generated by a position encoder on said injection plunger.

10. The method for controlling a vacuum die casting system of claim 6 wherein the step of calculating a second speed based on said first speed comprises adding a percentage value to said first speed.

11. In a vacuum die casting machine, a control system for the vacuum die casting machine having a mold having a cavity, vacuum means connected to said mold for evacuating said cavity, a vacuum valve between said cavity and said vacuum means, and an injection plunger for filling said cavity with material, said control system comprising:

speed input means for entering a first speed of said injection plunger;

speed processing means for calculating a second speed based on said first speed and for determining when said injection plunger has reached said second speed; and means for closing said vacuum valve when said injection plunger has reached said second speed.

12. The control system of claim 11 wherein said speed processing means comprises a position encoder and a high-speed counting device for measuring the speed of said injection plunger and for comparing said measured speed with said second speed.

13. The control system of claim 11 further comprising:

position input means for entering a first position and a second position of said injection plunger at which said vacuum valve should respectively open and close;

position processing means for determining when said injection plunger has reached said first and second positions; and means for opening said vacuum valve when said injection plunger has reached said first position and for closing said vacuum valve when said injection plunger has reached said second position.

14. The control system of claim 13 wherein said position processing means comprises a position encoder and a high-speed counting device for measuring the position of said injection plunger and for comparing said measured position with said first and second positions.

15. The control system of claim 11 wherein said speed processing means for calculating said second speed adds a percentage value to said first speed.

* * * * *